United States Patent [19]

Schnitzer

[11] 4,022,388

[45] May 10, 1977

[54] MOTORIZED CEREAL MILL

[76] Inventor: Johann Georg Schnitzer, Feldbergstr. 26, D-7742 St. Georgen, Germany

[22] Filed: Oct. 6, 1975

[21] Appl. No.: 620,116

[30] Foreign Application Priority Data

Oct. 9, 1974 Germany ..... 2448013

[52] U.S. Cl. ..... 241/246; 241/259.1

[51] Int. Cl.² ..... B02C 7/14

[58] Field of Search ..... 241/100, 152 A, 162, 241/244, 246, 248, 259.1

[56] References Cited

UNITED STATES PATENTS

| | | | |
|---|---|---|---|
| 133,455 | 11/1872 | King | 241/162 |
| 303,708 | 8/1894 | Coles | 241/246 |
| 755,989 | 3/1904 | Baker et al. | 241/246 |
| 1,159,138 | 11/1915 | Vecchini | 241/162 |
| 1,816,050 | 7/1931 | Lee | 241/100 |
| 2,297,637 | 9/1942 | Sullivan | 241/259.1 |
| 2,402,170 | 6/1946 | Lund | 241/246 |

*Primary Examiner*—Granville Y. Custer, Jr.
*Attorney, Agent, or Firm*—Lackenbach, Lilling & Siegel

[57] ABSTRACT

A motor-driven cereal mill, adapted for household use, incorporates a stationary upper millstone and a rotatable lower millstone of cast composition. Both millstones are borne in carriers, with the upper millstone carrier vertically adjustable inside a milling enclosure, in order to vary the milling gap between the milling faces. A worm drive is employed to adjust the milling gap, and means are also provided for a variable lower stop for the travel of the stationary millstone carrier, in order to provide means for the compensation of service wear in the milling faces. An electric motor is mounted alongside the milling enclosure and drives the vertical shaft, which engages the rotating millstone carrier, via a transmission, which is located below a common mounting plate for the motor and the mill enclosure. A removable receptacle is provided for the milled flour.

15 Claims, 11 Drawing Figures

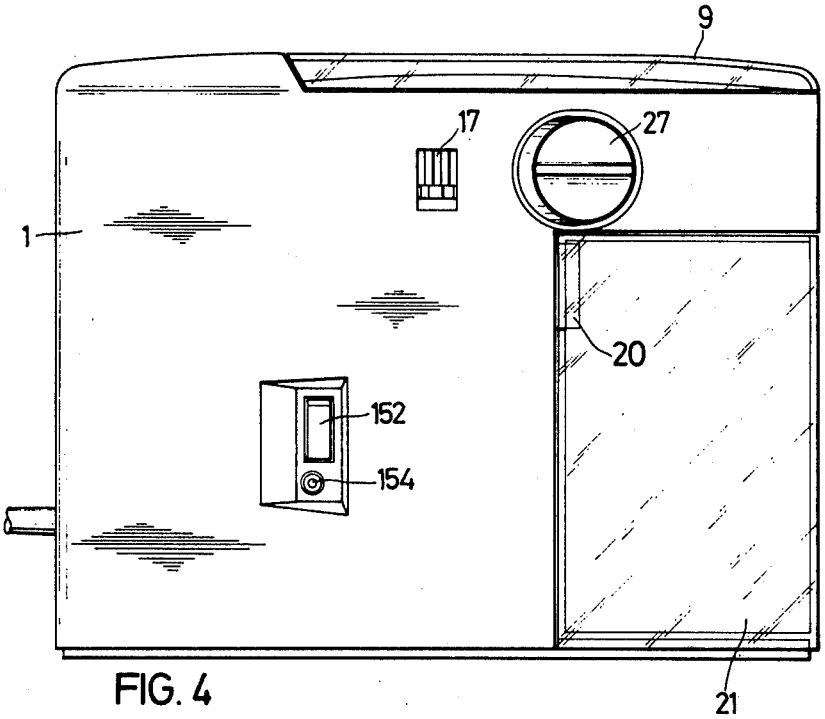
FIG. 4
FIG. 5
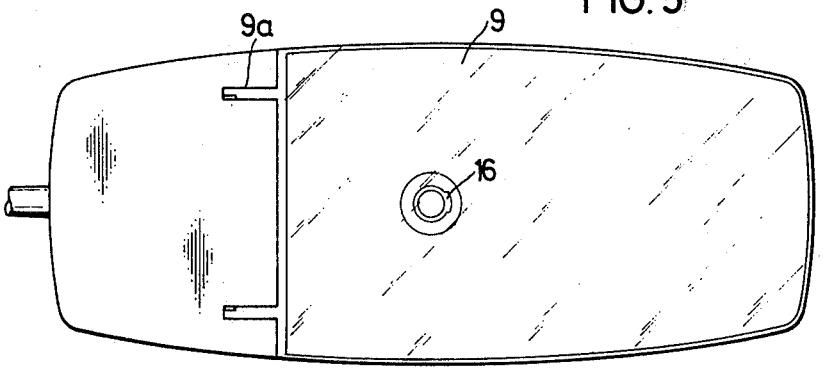

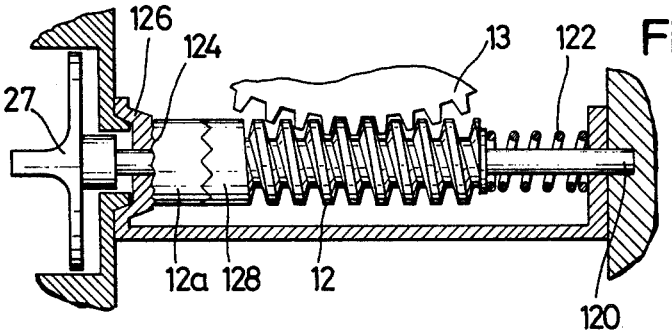
FIG. 8a
FIG. 8b
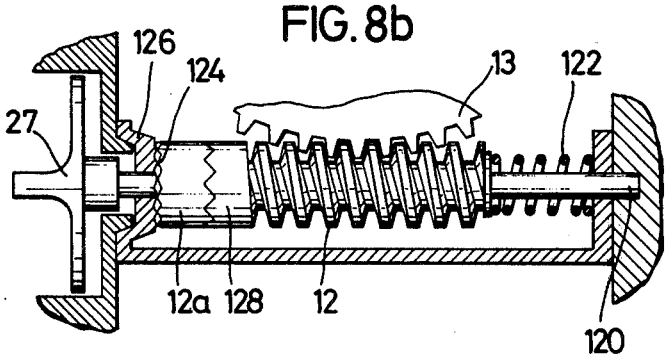
FIG. 8c
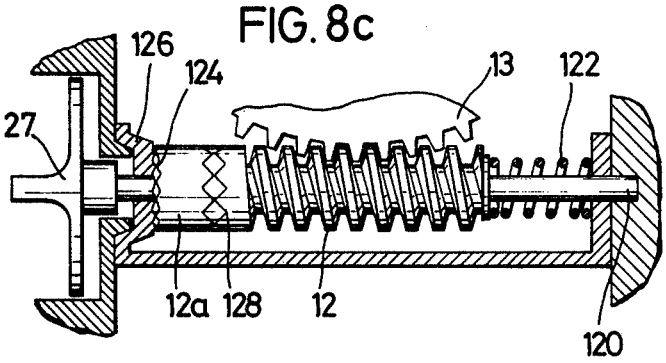

MOTORIZED CEREAL MILL

BACKGROUND OF THE INVENTION

The invention relates to a cereal mill for household use. It relates, more particularly, to such a mill wherein a stationary millstone is held in a housing and a rotatable shaft, located in that housing, supports a rotating millstone adjacent to the stationary one, with a drive for the shaft and means for adjusting the relative elevation of the stationary millstone with respect to the rotating one.

A cereal mill corresponding to the aforementioned description is disclosed in German Design Pat. No. 1,996,150; such devices of the prior do not, however, correspond to the requirements of the present day, including the provision of electrical drives, which are not readily incorporated in such prior art devices. Furthermore, the fineness of the milled flour can only be controlled very inaccurately in the device of the prior art, since the adjustment therefor requires the axial relocation of the shaft carrying the rotating millstone by means of jamnuts engaged on that shaft.

It is, therefore, the primary object of the invention to teach the construction of a compact cereal mill, particularly adapted to household use, wherein the fineness of the milled flour is easily adjusted and the wear of the millstones simply compensated for.

SUMMARY OF THE INVENTION

The objects of the invention are attained in a device wherein the stationary millstone is fastened to a supply tube in communication with a supply funnel for the mill feed, and wherein that stationary millstone is borne on a carrier which is provided with peripheral teeth engageable by a worm for the purpose of height adjustment.

The milling fineness of the cereal mill of the invention is particularly easily adjusted from the outside of the mill, an adjustment being preferably accomplished by the alteration of the elevation of the stationary millstone thereof. In addition to the adjustment of the flour fineness, it is possible to compensate for the wear of the millstone, caused as a result of lengthy service, by means of a normally stationary, intermediary ring. The offset between the stationary millstone carrier and the intermediate ring is visible through a sightport in the housing — another advantage of the mill of the invention — so that the milling gap governing the flour fineness can be determined visually.

Another advantageous development of the invention is the development of the driveshaft of the rotating millstone as a feed spindle in the intake region of the mill. A uniform supply of cereal grain is, thereby ensured from the feedstock in the inlet funnel into the milling space between the two millstones. A supply sleeve, surrounding the aforementioned feed spindle, may be advantageously provided with an axial groove; by restricting the dimensions of this groove to encompass a single kernel in its cross-section, a restricted transport of cereal grain may be attained and the overfilling of the milling space prevented. A slider may also be provided in the groove, such that moving the slider will control the cross-section thereof, so that the groove may be adapted to the several potential grains to be milled.

In another embodiment of the invention, the driveshaft may be developed into a milling hob in the intake region of the mill, as taught in my copending U.S. application, Ser. No. 613,866. In such an embodiment a spiral feed-groove, narrowing in cross-section downwardly, would be provided. Such a co-operating arrangement of a milling hob and a spiral spindle permits the milling of a wide variety of cereal grains — wheat as well as corn — in the device of the invention, since grains with larger kernels can be reduced to a uniform feed size by the pre-milling action of the milling hob.

It is possible, and in some instances advantageous, to provide a plurality of annular spaces around the periphery of the carrier for the rotating millstone for the reception of the milled flour or product. The rotating carrier is preferably provided with external paddles or wings which sweep flour from such annular spaces to a single discharge opening. All such annular spaces communicate with such a discharge port in the wall of the cereal mill with the port overlying the entry opening of a container provided attachably to the mill. To interdict the intrusion of flour into the bearings of the rotating millstone carrier a plurality of seals may be provided between the carrier and the mill housing and ahead of the uppermost thrust washer.

The preferred drive for the cereal mill includes an electric motor located in an external enclosure which is connected to the driveshaft — and feed spindle — by means of a transmission, comprised, for example of toothed pulleys and mating toothed belts. The motor may also be used to drive a an which draws a flow of cooling air through intake slits and forces it past the millstone to remove the heat generated by the milling process prior to discharging them through exhaust grills. To assist with the cooling process an additional fan may be attached to the driveshaft of the rotating millstone. It is important — in considering the action of these fans — that the motor cooling air need not be utilized in cooling the millstones, and a potentially deleterious influence on the taste of the milling product can, thereby be avoided.

A particularly compact and advantageous construction of the household cereal mill is attained by mounting the drive motor on a baseplate and supporting the millstones, by means of columns, on the same plate with the interconnecting drive located underneath the baseplate.

The millstones are preferaby formed by casting, as described, for example, in German provisional Pat. No. 1,757,244.

BRIEF DESCRIPTION OF THE DRAWINGS

The preferred embodiment of the invention is described, below, with reference to the accompanying drawings, wherein:

FIG. 4 is a frontal view of the cereal mill of the invention, showing the controls thereof;

FIG. 5 is an external plan view of the mill;

FIGS. 8*a*, 8*b* and 8*c*, are partial views, illustrating the construction and operation of the adjusting mechanism for the control of flour fineness.

DESCRIPTION OF THE PREFERRED EMBODIMENT

Figure 1:
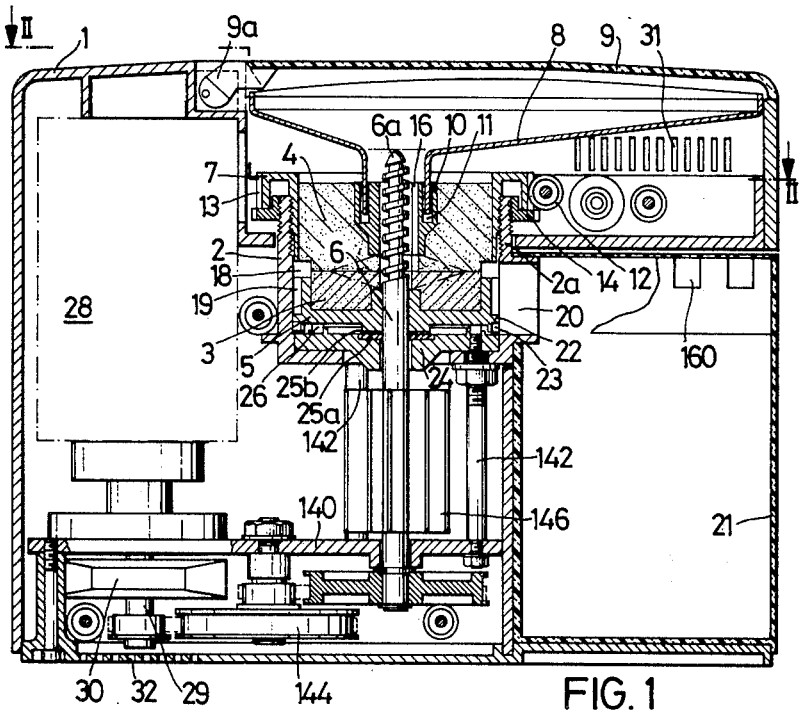
FIG. 1 is a view in elevation, partially sectioned, of the cereal mill of the invention, the section corresponding to section I—I in FIG. 2.
Figure 2:
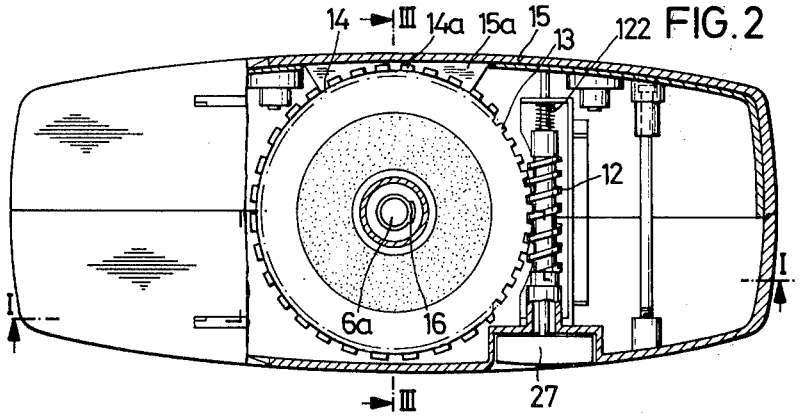
FIG. 2 is a plan view, in section, of the embodiment of FIG. 1, taken along section line II—II in that FIG.

The cereal mill shown in a front view in FIG. 1 in partial section corresponding to secton I —I in FIG. 2, is enclosed in a housing 1, into which is set a milling enclosure 2 with millstones 3 and 4. The lower millstone 3 is borne on a carrier 5, securely attached to a driveshaft 6. The upper millstone 4 is secured in a carrier 7, stationary inside the enclosure 2.

Figure 7:
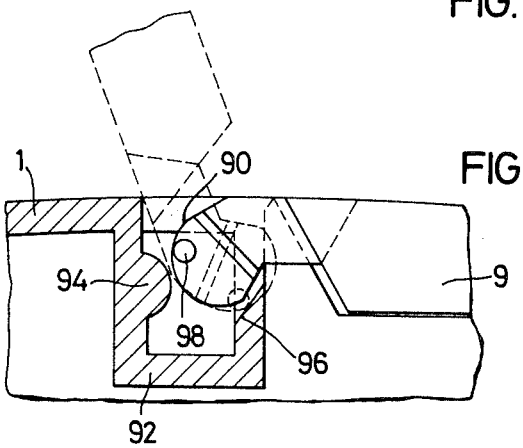
FIG. 7 is an enlarged detail, showing the design of the cover hinge portion.

A removable supply funnel 8 is located in the upper portion of the cereal mill, into which the feedstock to be milled is charged. The upper face or top, of the housing 1 may be covered with a cover 9, which is attached to that housing by means of a suspension 9*a*. The suspension 9*a* comprises, as more clearly illustrated in FIG. 5, two ears 90 at either side of the cover 9. FIG. 7 is a more detailed view of the suspension. The ears 90 are engaged in elongated depressions 92 in the housing 1, and sit — on a rounded, sliding face in each depression — on cylindrical projections 94 and sharp-edge projections 96 in each of the elongated depressions 92. The cover 9 is adapted to be roatated, on its ears 90, from a closed position to an open position shown in broken outlines in FIG. 7. The ears 90 are retained in the depressions 92 by means of side projections, or buttons, 98. Should the cover be forced past the open position, the ears deform and the buttons 98 are released, thereby achieving a two-fold purpose: the potential removal of the cover for cleaning, and the prevention of damage thereto in the event of improper handling.

Figure 3:
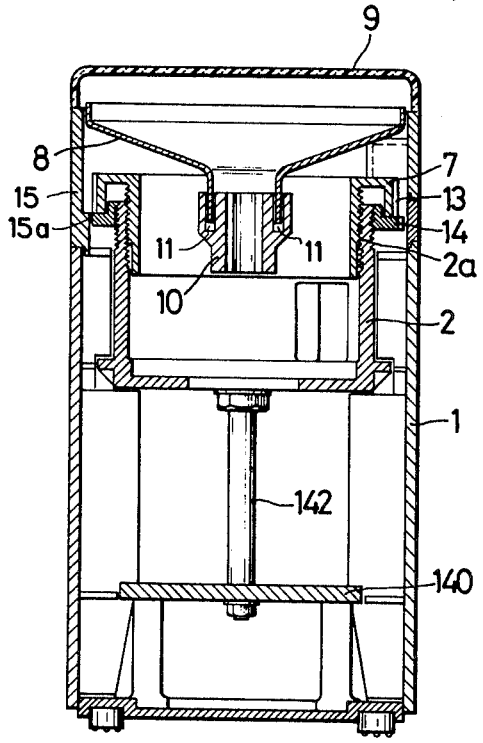
FIG. 3 is transverse section — taken along section line III—III in FIG. 2, of the preferred embodiment, with the rotationally free assembly of the driveshaft and millstone omitted therefrom.

A supply sleeve 10 is located in the stationary millstone 4, as clearly illustrated in FIGS. 1 and 3, and incorporates an upwardly open circular groove 11.

A wormdrive 12 engages mating teeth 13 provided on the outer periphery of the stationary millstone carrier 7 — with the worm in a horizontal alignment, as shown in FIG. 1 — and serves as the adjusting means for the milling fineness. The stationary millstone carrier 7 is advantageously provided with a cross-section — symmetrical about the rotational axis of the mill — in the shape of an inverted L, in the external flange portion of which the teeth 13 are pressed or milled. The vertical location of the carrier 7 — and of the stationary millstone 4 — may be altered by rotating the wormdrive 12.

The detailed construction of the wormdrive 12, and the operation of the adjusting mechanism for vertical motion of the millstone carrier 7, is shown in the enlarged views, FIGS. 8*a*, 8*b*, and 8*c*. The wormdrive 12 is mounted on a shaft 120 in an axially reciprocable engagement the shaft 120 not being reciprocable in the housing or rotatable by the knob 27. The worm 12 may be constructed as an integral unit with dog-clutch 128. The worm 12 and the clutch 128 are both reciprocable on the shaft 120 and are freely rotatable with respect thereto. The segment 12*a* is axially reciprocable on the shaft 120, but is secured to the shaft in the manner of a keyed sleeve. The segment 12*a* is also made integral with the shaft of the knob 27, or is securely affixed thereto. A compression spring 122, coaxial with the shaft 120, presses one face of the segment 12*a* — identified by the numeral 124 — into a mating dog-clutch 126 affixed in he housing. The mating teeth of the face 124 and the dog-clutch 126 secure the worm 12 against rotation with respect to the housing, while in engagement. A knob 27 serves as the means for adjustment, it is located on the outside of the housing 1. The worm 12 is engaged by a segment 12*a*, intermediate the knob 27 and the locus of engagement with the wormwheel 13, by means of a torque limiting dog-clutch 128, the mating surfaces of segment 12*a* and dog-clutch 128 being held in contact by the spring 122.

FIG. 8*a* is a view of this adjusting mechanism in its inactive condition, during the operation of the mill. The compression spring 122 presses the wormdrive assembly, including the worm 12, against the stationary clutch face 126. Consequently, a self-induced rotation of the assembly is impossible while the mill is operating, and so is an adjustment of the milling gap. The rotation of the adjusting knob 27 overcomes the force of the spring 122 and allows the clutch face 124 to disengage clutch 126 and, thereby, permits the rotation of the wormdrive, as illustrated in FIG. 8*b*, unitl a cessation of rotation of the knob 27 allows reengagement with the dogclutch 126. In operation, the knob 27 is turned and, hence, the segment 12*a*, which is in some manner secured thereto, is also turned. To allow for ease of adjustment, the knob 27 may be pressed inwardly to facilitate separation of the face 124 and the clutch 126. This causes the clutch 128 and, thus, the worm 12 to rotate. The rotation of the worm 12 causes the teeth 13 to be set in motion, since the teeth 13 engage the worm 12. To prevent any damage to the wormdrive through a mistaken operation of the knob 27 when the carrier 7 had already reached the lower or upper limit of its travel, the torque-limiting clutch 128 is interposed in the system. As the knob 27 rotates the segment 12*a*, rigidly keyed to the knob, the clutch 128 begins to slip when the continued rotational movement of the teeth 13 is no longer possible. The worm 12 remains in engagement with the teeth 13 on the carrier 7 while the clutch 128 slips, as illustrated in FIG. 8*c*.

To ensure the transport of the feedstock independently of the height adjustment of the stationary millstone, one end of the funnel 8 is inset into the circular groove 11 of the supply sleeve 10. The depth of the groove 11 and the mating length of the funnel discharge tube are so chosen that the engagement of the latter in the former is ensured at all possible vertical positions of the stationary millstone carrier 7, without mechanical interference. Means are also provided to prevent an upward displacement of the stationary millstone 4, and of its carrier 7 to an elevation where disengagement from the enclosure 2 could occur. This limitation of the upward displacement of the millstone 4 is achieved when the lower edge of the funnel 8, which is inset into the groove 11, comes into contact with the base of the groove 11. As may be seen in FIGS. 1 and 3, the funnel 8 prevents any further upward motion of the millstone 4. The vertical extent of the groove 11 does, therefore, define the maximum upward displacement of the millstone 4.

The stationary millstone carrier 7 is surrounded by a portion 2*a* of the enclosure 2 into which an external thread is machined, for the reception of an intermediate ring 14. The ring 14 may be moved vertically, by rotation with respect to the aforementioned external thread on portion 2*a*, and provides a lower bound to the motion of the carrier 7 downwardly. The interplay of these components allows the vertical movement of the carrier 7 and of the stationary millstone 4, with respect to the rotating millstone 3, while ensuring continuity between the funnel 8 and the supply sleeve 10.

A minimum gap between the stationary millstone 4 and the rotating millstone 3 may be set by the adjustment of the intermediate ring 14, which, as already described, forms a lower stop to the motion of the stationary millstone carrier 7. Furthermore, the ring 14 provides, in a particularly advantageous manner, means for alignment of the stationary millstone in a coaxial alignment with respect to the rotating millstone, thus overcoming the uncertainties inherent in the unavoidable manufacturing tolerances in the assembly. This tends to prevent a non-uniform wear of the co-operating millstones induced by relative pendular motion.

The alignment between the stationary millstone carrier 7 and the portion 2*a* of the milling enclosure 2 is ensured in a preferred manner by the provision of an internal thread in the carrier 7. A height adjustment of the stationary millstone carrier 7 is achieved, accordingly, by an angular displacement of the carrier/millstone assembly through the agency of the worm-drive 12. When the worm 12 engages the teeth 13, it causes the carrier 7 to be rotated. This rotation will cause the carrier 7 to be screwed either towards or away from the millstone 3, because of the action of the threads on the carrier 7 and on the portion 2*a*.

The elevation of the intermediate ring 14 may be adjusted, as for example for the compensation of wear in the millstones affecting the minimal milling gap between them, by providing access to the ring 14 through the removal of a portion 15 of the rear housing, as shown in FIG. 2. The outer periphery of the ring 14 is interrupted by toothed projections 14*a*, which are engaged by mating comb-like projections on the inner face of the housing portion 15, forming part of an arcuate segment 15*a*. After the adjustment of the position of ring 14, the housing portion 15 is replaced and, thus, prevents further rotation of the ring and, consequently, further changes in the lower limit of milling gap adjustment.

The adjustability of the stationary millstone 4 downwardly permits compensation for the wear of millstones 3 and 4. The adjustment of the stationary millstone 4 with respect to the rotatable millstone 3 follows a simple procedure: the two millstones are brought into contact; the statonary millstone carrier 7 is then backed off until the two millstones are just apart, and the intermediate ring 14 is brought upward to correspond to this new position of the carrier; and lastly, the ring 14 is secured in this new position by the insertion of the housing portion 15. The actual milling gap may be inspected through a view port 17 — shown in FIG. 4 — through which the offset between the carrier 7 and the ring 14 is visible. This offset corresponds to the milling gap — and a corresponding fineness in the flour milled — and can be adjusted by means of the worm-drive 12.

The feedstock is carried from the funnel 8 into the milling space between the two millstones by means of a feed spindle 6*a*. As shown in FIG. 1, the shaft 6 can be developed as the feed spindle. The supply sleeve 10 is interrupted in its inner face, opposing the feed spindle 6*a*, by a channel 16, through which the feedstock may be transported into the milling space from the funnel 8. The channel 16 and the feed spindle 6*a* are so designed to interact, that the transport path defined therebetween can only accomodate a single grain kernel at one time. This results in an advantageous forced feed. An additional sliding member, not shown in the drawings, may be installed in the channel 16 and operated from the outer face of the housing, so that the entry cross-section of the channel be be altered, as required to adapt the feed-path to a different feed grain. This makes it possible to work with differing materials. The spiral groove of the feed spindle 6*a* may be so dimensioned, and its slope so chosen, as to adapt the grain supply quantity and speed to the dimensions of the millstones.

A rotating millstone carrier 5, which is securely fastened to the shaft 6, with a transverse section in the form of a U, is also provided and it defines an annular space 18 between the two millstones and the enclosure 2, as well as another annular space 19 between itself and the enclosure. Both of these annular spaces communicate with a discharge port 20, and, therethrough, with a receptacle 21, as shown in FIG. 1. A sealing ring 22 is also provided at the periphery of the millstone carrier 5, defining an additional annular space 23 between the carrier's base, the mill enclosure 2 and an upper thrust bearing plate 24. The flour is discharged into the annular space 18 outside the stationary and rotating millstones, and falls into the annular space 19 immediately below and between carrier 5 for the rotating millstone 4 and the enclosure 2. The carrier 5 is fitted with radially projecting paddles or wings — omitted from the illustration for the sake of clarity — whose dimensions correspond to the section of the annular space 19 and which carry the flour deposited therein to the discharge port 20. The sealing ring 22, defines the separation between annular spaces 19 and 23. The rotating millstone carrier 5 also carries paddles projecting into the annular space 23, and transports flour bypassing the sealing ring 22 around the circumference thereof to the port 20. The arrangement of the several annular spaces 18, 19 and 23 inhibits, to a considerable extent, any intrusion of flour into bearings 25*a* and 25*b* between the rotatable millstone carrier 5 and the upper thrust bearing plate 24. In a preferred embodiment of the mill of the invention, an additional seal, as represented by a felt ring 26, is interposed between the millstone carrier 5 and the thrust plate 24, with the seal 26 secured by an appropriate form of the thrust plate 24. Self-lubricating plastic compositions are utilized, by preference, for the bearings 25*a* and 25*b*.

The millstones 3 and 4 may be of a cast variety, as described in German provisional Pat. No. 1,757,244.

The plan view of FIG. 2 is taken through the cereal mill corresponding to the section line II—II in FIG. 1. It illustrates clearly the engagement between the intermediate ring 14 and the comb-like stop structure 15*a* in housing portion 15. The ring 14 is held stationary in the view of FIG. 2.

The rotational drive to the shaft 6 is derived from an electric motor 28. The motor 28 is mounted vertically on a mounting plate 140. The actual milling apparatus — encompassing the mill enclosure 2, the millstone carriers 5 and 7, the mill-stones 3 and 4, and the co-operating components — is mounted on the same mounting plate 140 adjacent to the motor 28 by means of columns 142. This results in a compact and low structure for the cereal mill.

Figure 6:
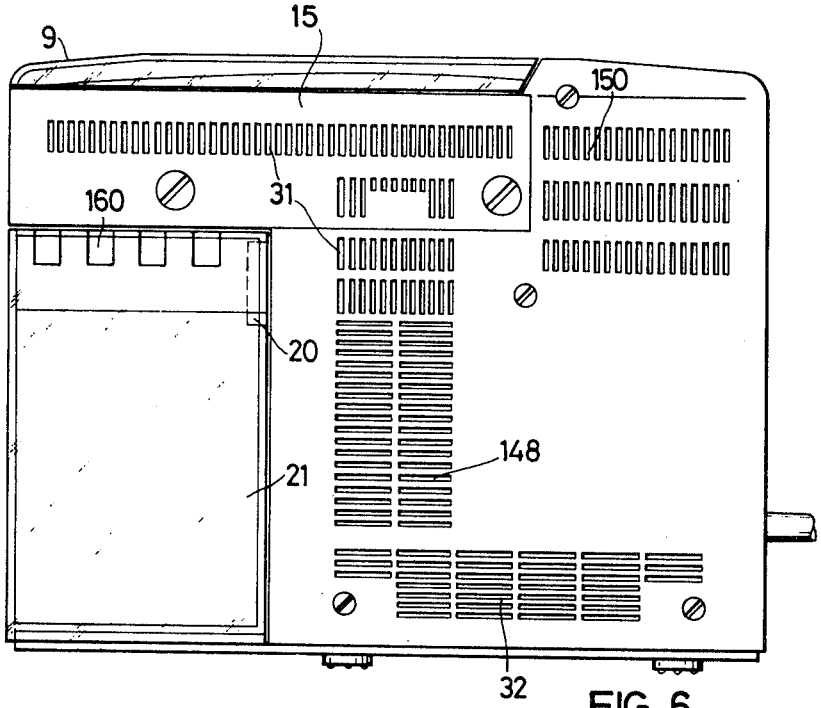
FIG. 6 is a rear view of the outer housing of the embodiment of FIG. 1.

Shaft 29 of the motor 28 is interconnected with the shaft 6 by a transmission 144 below the mounting plate 140, the transmission incorporating gears and/or toothed belt drives. A fan 30 is also mounted on the shaft 29. A further fan 146 is mounted on the shaft 6 between the mounting plate 140 and the mill enclosure 2. Exhaust slits 148 and intake grills 31 are provided in the housing, as shown in FIG. 6. A stream of air is drawn through grills 31, mainly by the fan 146, and serves to cool the millstones. The bulk of this airstream is discharged through the exhaust slits 148. Another airstream is drawn through grills 150 by the fan 30 and discharged through the exhaust slits 32; this stream serving mainly to cool the motor 28.

An on-off switch 152 is mounted in the frontal face of the housing for controlling the electric motor 28. Overload protection is also provided to prevent a burnout of the motor windings in the event that the millstones seize. A reset button 154 is provided to permit restarting the motor should the overload protecting device be actuated.

Figure 9:
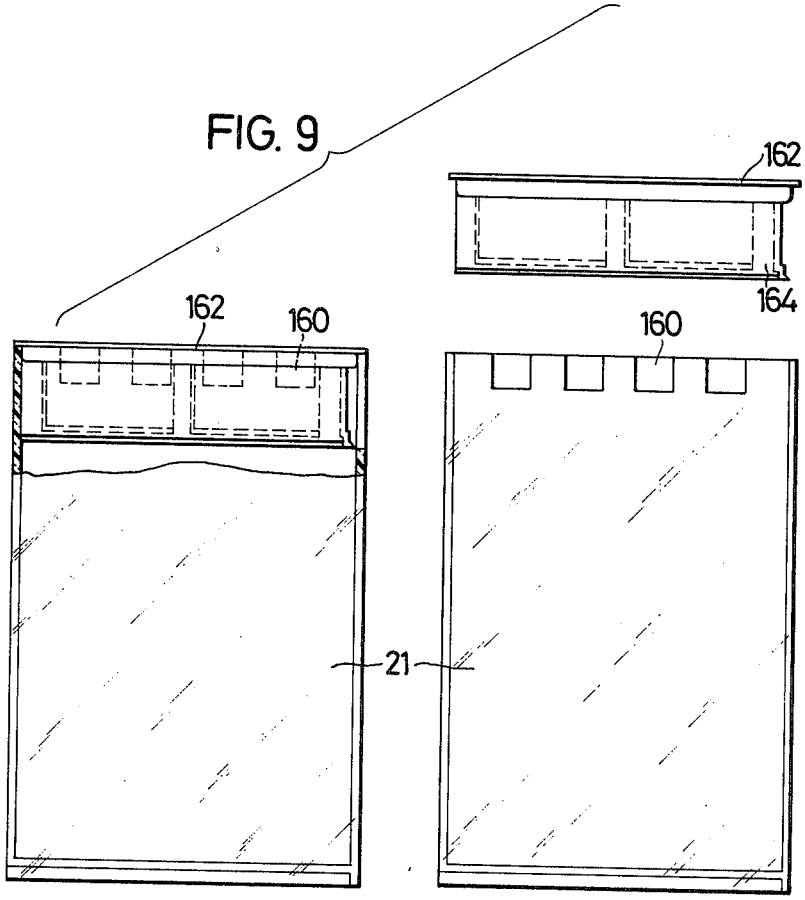
FIG. 9 is a detail view of the receiving container for flour milled in the cereal mill of the invention, as incorporated in the embodiment of FIG. 1, shown in both the closed and open positions.

The housing 1 is undercut beneath the milling gap adjusting mechanism, to receive receptacle 21. The upper edge of the receptacle 21 is provided with an opening which may be engaged by the discharge port lip 20, whenever the receptacle is placed inside the housing. The receptacle 21 is made from a transparent plastic, so that the amount of flour discharged thereinto may be visually determined from the outside. As shown in FIG. 9, the receptacle 21 is provided with openings 160 for the discharge of air, and is closed by a cover 162. The cover 162 has a rim 164 depending from the plane of the cover made from a filter medium, so that the openings 160 are closed off by a layer impassable to dust particles but open to air. The rim 164 may be formed of a frame encompassing the cover 162 upon which strips of filter paper are secured.

The invention has been described hereinabove with reference to the preferred embodiment thereof; minor variations in the detail design of the several components therein in their relative arrangements and in their constructional materials may occur to one skilled in the art upon exposure to the teachings herein. Such changes and variations are deemed encompassed by the disclosure, and the invention is delimited only by the appended claims.

I claim:

1. A cereal mill adapted for household use having a housing, an enclosure in said housing, a stationary millstone positioned in said enclosure, a shaft rotationally engaged in said enclosure, a rotatable millstone secured to said shaft in opposition to the stationary millstone, a drive for the shaft, and means for adjusting the relative height of the stationary millstone with respect to the rotatable millstone, wherein said means for adjusting comprises:

a supply sleeve, with a channel extending therethrough, fastened to said stationary millstone and having an upwardly open circular groove; a funnel for the feedstock inset in said groove;

a carrier for the statonary millstone secured to said enclosure and having external gearteeth; and a worm drive engaging said gearteeth for the height adjustment of said stationary millstone.

2. The cereal mill of claim 1, wherein said worm drive is rotated by a knob mounted on the outside of said housing.

3. The cereal mill according to claim 2, wherein said worm drive is axially reciprocable and is held by a coaxially mounted spirally wound spring against a clutch face provided in said housing, with said clutch face engaged by a mating end of said worm drive.

4. The cereal mill according to claim 3, wherein said worm drive and said adjusting knob are separated by a slip-clutch.

5. The cereal mill according to claim 1, wherein said channel of said supply sleeve is an axial channel in said sleeve's orifice opposite the upper end of said shaft passing through said sleeve.

6. The cereal mill of claim 5, wherein said shaft is formed into a feed spindle at least in the region encompassed by said supply sleeve.

7. The cereal mill according to claim 1, wherein an intermediate ring limits the height adjustment of the stationary millstone in the direction of approach to the rotatable millstone.

8. The cereal mill according to either claim 7, wherein said intermediate ring is threaded onto an external thread of a cylindrical portion of said enclosure for purposes of height adjustment.

9. The cereal mill of claim 8, wherein said intermediate ring is provided with projections spaced around its periphery, said projections being at least partially engageable by complementary portions of a rearward section of said housing.

10. The cereal mill according to claim 8 wherein said cylindrical portion is provided with an internal thread for the engagement of an external thread on an outside face of said carrier for the stationary millstone.

11. The cereal mill according to claim 1, wherein said rotatable millstone is secured to a millstone carrier which is attached to said shaft.

12. The cereal mill of claim 11 wherein said carrier of said rotatable millstone defines at least two annular spaces with respect to said enclosure which communicate with a receptacle through a discharge port.

13. The cereal mill according to claim 12, wherein said rotatable millstone carrier is provided with a circumferentially mounted sealing ring.

14. The cereal mill according to claim 13, wherein a bearing plate is provided in said enclosure below said rotatable millstone carrier and an additional sealing ring is interposed between said bearing plate and said carrier.

15. The cereal mill according to claim 1, wherein said drive and said enclosure are mounted side by side on a common mounting plate said drive being mounted directly on said plate, and said enclosure being mounted by means of columns on said plate; and wherein a transmission is mounted below said plate and connects said drive and said shaft.

* * * * *